United States Patent [19]

Hepperle et al.

[11] Patent Number: 4,671,311

[45] Date of Patent: Jun. 9, 1987

[54] ADMIXER FOR DELIVERING SOLUBLE ADDITIVES

[75] Inventors: Willi Hepperle, Westerstetten; Johann Katzer, Neu-Ulm; Hans Froelich, Bernstadt; Christian Stephany, Ulm, all of Fed. Rep. of Germany

[73] Assignee: Gardena Kress & Kastner GmbH, Fed. Rep. of Germany

[21] Appl. No.: 753,400

[22] Filed: Jul. 10, 1985

[30] Foreign Application Priority Data

Jul. 19, 1984 [DE] Fed. Rep. of Germany ..... 3426576

[51] Int. Cl.[4] ..... B01F 3/12

[52] U.S. Cl. ..... 137/268; 422/282

[58] Field of Search ..... 137/268, 205.5; 422/261, 263, 264, 282

[56] References Cited

U.S. PATENT DOCUMENTS

| | | | |
|---|---|---|---|
| 1,786,561 | 12/1930 | Collenburg | 137/268 X |
| 1,967,909 | 7/1934 | Sonner | 137/268 X |
| 2,242,789 | 5/1941 | McFee . | |
| 2,582,175 | 1/1952 | Stitz | 137/268 X |
| 2,602,699 | 7/1952 | Otto | 137/268 X |
| 3,003,518 | 10/1961 | Tisdale | 137/268 |
| 3,271,809 | 9/1966 | Morawski . | |
| 3,349,788 | 10/1967 | Chesler | 137/205.5 |
| 3,619,874 | 11/1971 | Li . | |

FOREIGN PATENT DOCUMENTS

| | | |
|---|---|---|
| 1800022 | 4/1959 | Fed. Rep. of Germany . |
| 6807437 | 10/1976 | Fed. Rep. of Germany . |
| 3230783 | 2/1984 | Fed. Rep. of Germany . |
| 400929 | 9/1960 | Switzerland . |

*Primary Examiner*—Alan Cohan

*Attorney, Agent, or Firm*—Steele, Gould & Fried

[57] ABSTRACT

An admixer for delivering soluble additives to flowing liquids containing a valve with a rotary valve body and a container for receiving the additive in tablet form located in the extension of the valve body. The valve body contains an outer channel guide which can be made to coincide with the valve inlet port and a tubular water guide leading through the interior of the valve body.

12 Claims, 7 Drawing Figures

ADMIXER FOR DELIVERING SOLUBLE ADDITIVES

Figure 1:
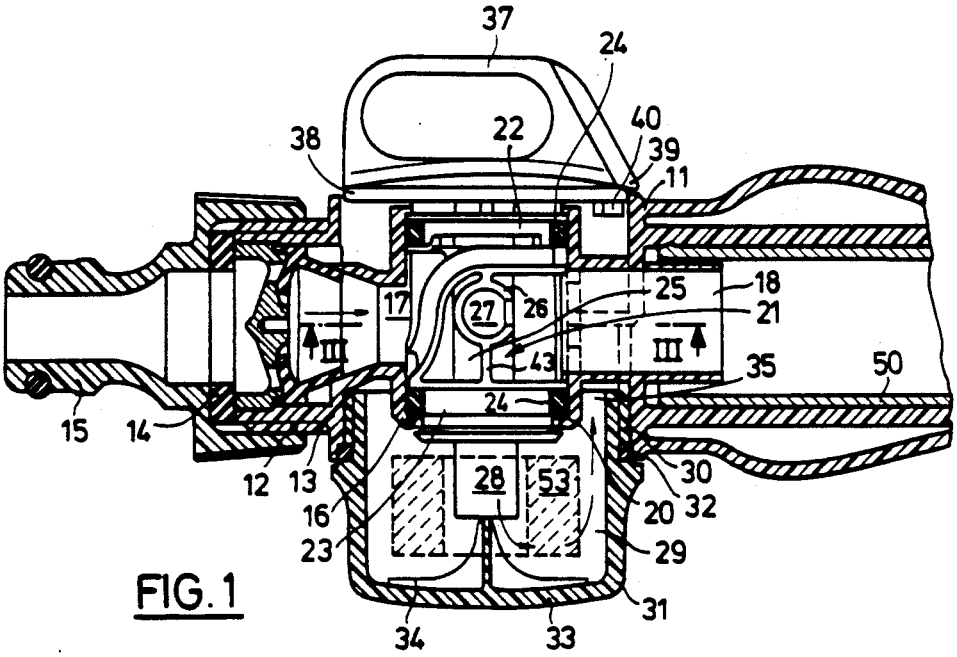

The invention relates to an admixer for delivering soluble additives to flowing liquids, with a liquid inlet into and a liquid outlet out of the admixer, a receiving container for the additive, as well as a valve for delivering, as required, additive-free and additive-added liquid, whose rotary valve body controls a liquid guide for the direct connection of a valve inlet port to the liquid outlet and a second liquid guide for connecting the valve inlet port to the receiving container.

Such an admixer is known from DE-OS 32 30 783. In this known admixer, the rotary valve body must be able to sealingly cover a valve inlet port in a cylinder surface and also an inlet port in the receiving container, which is located in the end wall of the cylinder. Thus, the valve body has two sealing surfaces. The valve body must be introduced from above into the valve casing after which a cover is mounted thereon, and a rotary knob must be fitted.

A washing brush is also known, which has a valve enabling both clean water and water containing a liquid detergent to be passed into the washing brush, (DE-OS 20 38 625). The valve is once again a rotary valve, there being an opening both in the cylindrical wall of the valve casing and in the end face of the latter and each of these openings must be sealed with respect to the valve body. The additive receiving container is positioned laterally alongside the rotary valve body.

A similar apparatus is known from U.S. Pat. No. 1,677,645, where a rotary valve is provided, which has two separate passages and which must be sealed with respect to a total of four bores.

The problem of the present invention is to provide an admixer for delivering soluble additives to a flowing liquid, which has a simple, uncomplicated construction, operates reliably and ensures a good valve control possibility.

According to the invention this problem is solved in that the liquid guide for the additive is constructed as a closed channel arranged within the valve body and which issues in the outside of the valve body and in the receiving container in the form of an opening.

As a result of this construction, the valve body need only have one opening, which can be sealed with respect to the valve body, namely the inlet port. The outlet port for the clean water, as well as the discharge opening of the addition channel in the additive receiving container need not be sealed.

According to a further development, the liquid outlet from the receiving container issues downstream of the valve into the admixer liquid outlet. This ensures that no clean water can flow back into the receiving container, so that as a result the valve can have a very simple construction.

The invention proposes that the valve has a circular cylindrical valve casing, in which is located the valve inlet port and the cylindrical valve body has at least one leading edge cooperating with the valve inlet port. Thus, advantageously the valve body can be positioned at right angles to the liquid flow direction and the receiving container can be arranged in the extension of the rotation axis of the valve body. This leads to an extremely simple construction, because the liquid channel for the additive can be constructed as a bore located in the rotation axis and which can be met by a radial bore.

The invention also proposes that the valve body is constructed in one piece with a rotary knob and can snap into the valve casing. As a result of the circular cylindrical construction of the valve casing interior the valve body can easily snap in and a shoulder can engage on the underside of the valve casing.

According to the invention, the valve body can also have a closure section for closing the valve inlet port. This makes it possible not only to permit a through-flow of clean liquid or liquid provided with an additive in variable quantities, but also the complete closing of the admixer and consequently the water passage.

For sealing purposes, the valve body can have an O-ring inserted in a slot, which in the vicinity of the closure section is positioned below the valve inlet port and in the remaining area is above the latter or vice versa. Thus, with the aid of a simple element, namely an O-ring, a simple sealing of both the closure section and also the channel for clean water and the channel for the additive-added water can be provided.

The invention also proposes that the addition channel, i.e. the channel leading into the additive receiving container is extended in tubular manner therein. This makes it possible to use a circular tablet as the additive in the addition container, and as a result of the tubular extension the water can be guided to one front face, so that it can flow out both along the outer and along the inner surface. As a result of this construction, the surface remains substantially constant, despite the fact that the tablet is subject to wear.

According to a further development, the receiving container has an annular space, preferably, outside the valve casing and from which the liquid can be removed. This leads to a uniform wearing away of the additive.

The tubular extension of the addition channel can extend into the vicinity of the facing container wall. In this area, the container wall is preferably provided with a whirling device, which ensures that the wearing away of the additive takes place as uniformly as possible.

According to the invention, the admixer can have a handle, so that it can be held in the user's hand. Due to the measures proposed by the invention, the admixer can be constructed so small and light, that as a portable apparatus it can be smaller than the handle.

To enable the admixer to be used in conjunction with a washing brush, a spray gun or similar accessories, the invention provides a connecting fitting for connecting to a further apparatus.

To permit a secondary flow through the additive receiving container, according to the invention the addition channel opening in the outside of the valve body has a smaller cross-section than the valve inlet port and has a tubular configuration. As a result part of the inflowing water can flow laterally past the tube and passes directly to the apparatus outlet.

Further features, details and advantages of the invention can be gathered from the claims, the following description of the preferred embodiment and the drawings. The individual features, either alone or combined, e.g. in the form of subcombinations, can represent advantageously and independently protectable constructions, for which patent protection is claimed.

In the drawings show:

FIG. 1 a section through the longitudinal axis of the admixer with an only partly represented handle.

Figure 2:
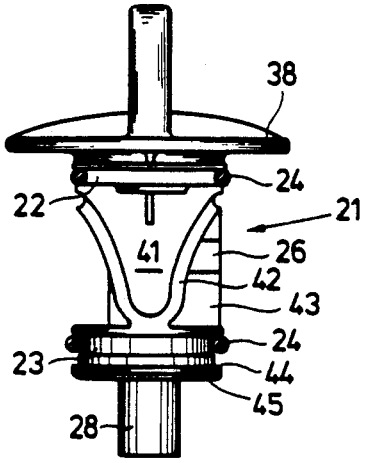

FIG. 2 a side view of the valve body from the left in FIG. 1.

Figure 4:
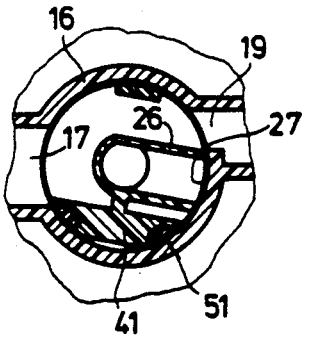
Figure 3:
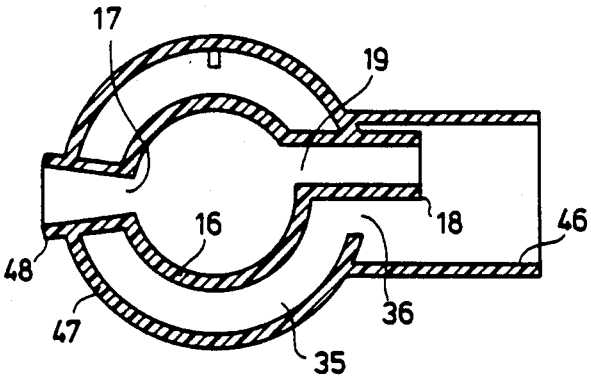

FIG. 3 a section through the valve casing approximately along line III—III of FIG. 1, FIG. 4 a section through the valve casing and the valve body in the position in which clean water flows through.

Figure 5:
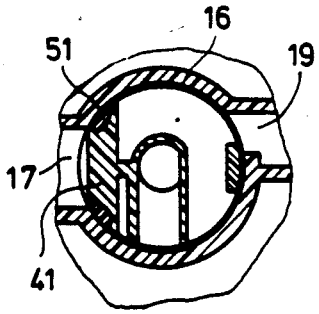

FIG. 5 a section corresponding to FIG. 4 with the valve closed.

Figure 6:
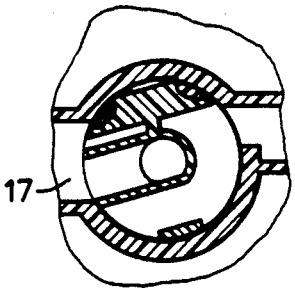

FIG. 6 a section corresponding to FIG. 4, in which the flow path through the receiving container is completely open.

Figure 7:
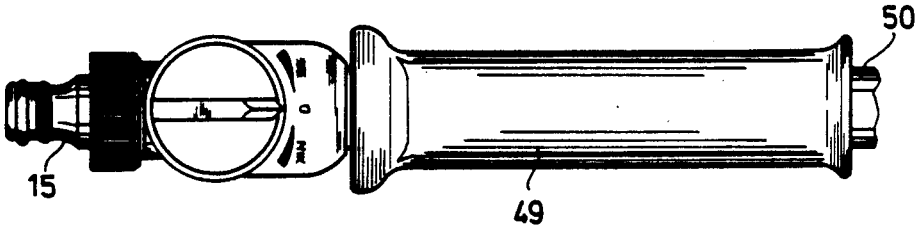

FIG. 7 a plan view of the admixer according to the invention on a reduced scale.

The admixer shown in FIG. 1 has a plastic casing 11 which, on its left-hand side in FIG. 1, has a shoulder 13 provided with a thread 12. Water can flow through the hollow shoulder 13 into the centrally arranged valve. Accompanied by the interposing of a gasket 14, a connecting fitting 15, constructed for connection to a tube, can be screwed into thread 12 of shoulder 13.

Within the casing 11 is provided a valve casing 16, which can e.g. be shaped like a circular cylindrical ring. On its side facing shoulder 13, valve casing 16 has a valve inlet port 17, which widens in funnel-like manner towards shoulder 13.

On the side opposite to the inlet on valve casing 16 is provided a pipe socket 18, whose interior is connected via an opening 19, cf. FIG. 3, to the inside of valve casing 16. Pipe socket 18 extends into the liquid outlet of the admixer.

On its outside, valve casing 16 is provided with an inwardly projecting edge 20, which forms a slight diameter reduction of casing 16. A one-part valve body 21 is placed in the valve casing and is rotatable about the longitudinal axis of cylindrical valve casing 16. In its upper edge area, and in its lower area, the valve body is provided in each case with an annular slot 22, 23, in each of which is provided an O-ring 24. The two O-rings 24 engage on the smooth inner wall of valve casing 16 and serve to seal the valve body.

The valve body is centrally traversed by a pipe 25 open in the direction of receiving container 29 and which is concentric to the rotation axis of valve body 21. A tubular extension 26 is fitted from the outside of valve body 21 and which has an approximately radial configuration and passes into pipe 25. Tubular extension 26 forms an opening 27, which can be made to coincide with the valve inlet port 17 by turning valve body 21. On its underside, valve body 21 has a tubular extension 28, which is located in the extension of pipe 25. Water flowing into opening 27 passes through the tubular extension 26, pipe 25 and extension 28 downwards into a container 29 receiving the additive. In this area, the admixer casing 11 has an internal thread 30, into which is screwed the container cover 31, a seal 32 ensuring a liquid-tight sealing action. The flat central wall 33 of container cover 31 has a whirling device, comprising four blades 34 which are at right angles to one another and which is positioned in the extension of pipe 25. The water passing out of extension 28 is whirled by the blades 34.

Outside the lower edge 20 of valve casing 16 is provided an annular space from which the water can pass through an opening 36 visible in FIG. 3 to the liquid outlet of the admixer.

On the side opposite to extension 28, valve body 21 has a rotary knob 37 with a plate 38, which closes the top of the valve casing. On the underside of plate 38, a shoulder 40 is fitted in the vicinity of tip 39 of knob 37, and together with a casing element said shoulder can be used for limiting the rotary movement of knob 37.

FIG. 2 shows the shape of the valve body 21. Below plate 38 is provided the first annular slot 22 with the seal 24 arranged therein. Below seal 24 is provided a closure section 41, cf. FIG. 2, which is bounded by a roughly V-shaped groove 42. To the right of the closure section 41 is provided a vertical wall 43, which contains pipe 25 with its opening 27. To the left of closure section 41 there is no material, so that at this point the water can flow through completely freely. An O-ring is inserted in groove 42 and follows the latter. On the other side of valve body 21 not visible in FIG. 2 the groove passes directly below slot 22 and parallel thereto, so that the O-ring there is substantially parallel to the O-ring 24.

Below the annular slot 23, valve body 21 has an outwardly projecting rib 44 with a chamfered shoulder 45 connected thereto. The upper edge of rib 44 is roughly perpendicular to the longitudinal axis of valve body 21, so that rib 44 can be fixed below the lower edge of valve casing 16. The insertion of the valve body is facilitated by sloping shoulder 45.

In the closed position, closure section 41 is arranged in such a way that it closes the valve inlet port 17. If valve body 21 is turned in such a way that the closure section 41 passes to the right in FIG. 2, then the water flowing through inlet port 17 can flow past the left-hand side of the seal contained in slot 42 and can flow out of the valve casing through the opening 19 visible in FIG. 3, there being no need to seal said opening 19 in the valve casing.

However, if the closure body is turned in the opposite direction, opening 27 of pipe 25 gradually is made to coincide with the valve inlet port 17, so that the water passes through openings 17 and 27, pipe 25 and extension 28 into container 29, for the additive. From there the water with the dissolved additive passes via annular space 35 and the opening into the outer connection 46, which forms the admixer liquid outlet.

FIG. 3 shows in section the circular cylindrical valve casing 16 without the valve body. The valve inlet port 17 and the outlet port 19 are arranged in the inner wall of valve casing 16. The outlet port 19 continues in a pipe socket 18, which leads into the connection 46. Valve casing 16 is surrounded by a circular cylindrical wall 37, whilst an approximately funnel-shaped line 48 forms the liquid connection between shoulder 13 and opening 17. The liquid which passes through the valve into the additive container 29 can pass from there through the annular space 35 and opening 36 into the outlet connection 46.

FIGS. 4 to 6 show sections through the valve casing 16 with inserted valve body. In FIG. 4 the valve body is turned counterclockwise until the closure section 41 has completely passed the valve inlet port 17. The water can pass directly out of openings 17 through the free space of valve body 21 and into outlet port 19. Opening 27 of tubular extension 26 is closed.

If the valve body is now turned clockwise, the valve inlet port is slowly closed until the position shown in FIG. 5 is reached, in which the valve inlet port 16 is completely closed by the closure section 41 and the admixer is then blocked.

On further clockwise turning, opening 27 of extension 26 gradually passes into the vicinity of valve inlet port 17 until the position shown in FIG. 6 is reached, in which the complete opening 27 is located within the inlet port 17. Water substantially flows through the extension 26, pipe 25 and extension 28 into the additive receiving container 29.

As is shown in broken line form in FIG. 1, the additive is in the form of a cylindrical tablet 53 with a longitudinal bore, which is somewhat larger than the diameter of extension 28. The liquid flows past both the inside and the outside of the cylinder ring, so that as the additive wears away there is substantially no change to the surface.

FIG. 7 shows a plan view of the admixer proposed by the invention. Immediately alongside the admixer is provided a handle 49, by means of which the admixer can be held. On the side of handle 49 remote from the connecting fitting 15, said handle is provided with a pipe 50, which is made from metal and can have a connecting fitting for fitting a further apparatus.

The admixer proposed by the invention can be used e.g. for adding detergents in car wash brushes, fertilizers to fertilizing equipment and other cleaning additives in other types of cleaning equipment.

We claim:

1. An admixer for delivering soluble additives to flowing liquids, comprising:

a casing having liquid inlet means and liquid outlet means;

a container for receiving said additives, mounted on said casing;

a rotary valve having a valve casing within said casing of the admixer and a valve body, the valve body being arranged within said valve casing for controlling a flow of liquid from said liquid inlet means to said liquid outlet means and to said container, said valve body being rotatable in the valve casing and having a closed inner channel arranged in its interior leading from an inlet of the rotary valve to outside of said valve body and into said container as an opening for the flow of liquid into said container when the valve body is rotated to orient the inner channel of the valve body to the liquid inlet means, said valve body being spaced from the casing around a part of its circumference to define an outer channel between the valve body and the valve casing adapted to coincide with the valve inlet and to controllably connect the liquid inlet means and the liquid outlet means, and closure means on the valve body for closing said liquid inlet means, said clousre means having at least one leading edge movable across said valve inlet with rotation of the valve body, said rotation controlling liquid passage into the container and liquid passage directly from said valve inlet between the valve body and the valve casing and into said outlet means, an outlet of the container issuing downstream of the valve casing into the liquid outlet means of the casing of the admixer and bypassing the valve casing.

2. Admixer according to claim 1, wherein the valve has a circular cylindrical valve casing in which is arranged said valve inlet.

3. Admixer according to claim 1, wherein said valve body is rotatable on an axis at right angles to a direction of the liquid flow and the container is arranged along a rotation axis of the valve body.

4. Admixer according to one of the preceding claims, characterized in that the valve body (21) is constructed in one piece with a rotary knob (37) and can snap into the valve casing (16).

5. Admixer according to claim 2 wherein said valve body has an O-ring inserted in a slot which is positioned in the vicinity of the closure means below said valve inlet and in the remaining area above the latter.

6. Admixer according to claim 1 wherein said container has an annular space outside the valve casing from which the liquid is removed.

7. Admixer according to claim 1 including a tubular extension for said closed channel which extends into the container.

8. Admixer according to claim 1 including a whirling device in the outflow area of said container.

9. The admixer of claim 2 wherein said valve body is centrally traversed by a pipe means open in the direction which is concentric to the rotation axis of said valve body.

10. The admixer of claim 9 wherein said valve body is positioned at right angles to the liquid flow direction and said container is arranged in the extension of the roation axis of the valve body.

11. The admixer of claim 1 whrein said container is provided with an annular space outside the valve casing from which liquid can be removed.

12. The admixer of claim 1 wherein said closure means in a closed position closes said valve inlet and movement of the closure means away from said inlet permits liquids to pass directly by the side of the leading edge through a free space of the valve body.

* * * * *

UNITED STATES PATENT AND TRADEMARK OFFICE

CERTIFICATE OF CORRECTION

PATENT NO. : 4,671,311

DATED : June 9, 1987

INVENTOR(S) : Willi Hepperle, Johann Katzer, Hans Froelich and Christian Stephany It is certified that error appears in the above-identified patent and that said Letters Patent is hereby corrected as shown below:

Column 1, line 14, after "DE-OS 32 30 783" insert --(equivalent to U.S. Patent 4,572,235)--.

Signed and Sealed this

Third Day of November, 1987

*Attest:*

DONALD J. QUIGG

*Attesting Officer*

*Commissioner of Patents and Trademarks*